US009702264B2

(12) United States Patent
Ueda et al.

(10) Patent No.: US 9,702,264 B2
(45) Date of Patent: Jul. 11, 2017

(54) VARIABLE NOZZLE UNIT AND VARIABLE GEOMETRY SYSTEM TURBOCHARGER

(71) Applicant: IHI Corporation, Koto-ku (JP)

(72) Inventors: Takafumi Ueda, Tokyo (JP); Akira Iwakami, Tokyo (JP); Naoki Tokue, Tokyo (JP); Masaru Nishioka, Tokyo (JP)

(73) Assignee: IHI Corporation, Koto-ku (JP)

( * ) Notice: Subject to any disclaimer, the term of this patent is extended or adjusted under 35 U.S.C. 154(b) by 533 days.

(21) Appl. No.: 14/261,593

(22) Filed: Apr. 25, 2014

(65) Prior Publication Data

US 2014/0334918 A1 Nov. 13, 2014

(30) Foreign Application Priority Data

May 9, 2013 (JP) ..... 2013-099059

(51) Int. Cl.
*F01D 17/16* (2006.01)

(52) U.S. Cl.
CPC ..... *F01D 17/165* (2013.01)

(58) Field of Classification Search
CPC ..... F01D 17/165
USPC ..... 415/160, 164, 165, 186
See application file for complete search history.

(56) References Cited

U.S. PATENT DOCUMENTS 4,654,941 A * 4/1987 Burdette ..... F01D 17/165 29/889.22
5,028,208 A 7/1991 Mitsubori et al.
6,907,733 B2 * 6/2005 Nishiyama ..... F01D 17/165 29/889.22
7,322,791 B2 * 1/2008 Stilgenbauer ..... F01D 17/165 415/160
2008/0260520 A1 * 10/2008 Hettinger ..... F01D 17/165 415/163

FOREIGN PATENT DOCUMENTS

CN 1692214 A 11/2005
CN 2864100 Y 1/2007
CN 101864996 A 10/2010
CN 102667100 A 9/2012
(Continued)

OTHER PUBLICATIONS

U.S. Appl. No. 14/598,254, filed Jan. 16, 2015, Ueda, et al.
(Continued)

*Primary Examiner* — Phutthiwat Wongwian
*Assistant Examiner* — Jason T Newton
(74) *Attorney, Agent, or Firm* — Oblon, McClelland, Maier & Neustadt, L.L.P.

(57) ABSTRACT

Three or more attachment pins are arranged on a right lateral surface of a nozzle ring at intervals. All the attachment pins are placed outside support holes in the nozzle ring in radial directions of the nozzle ring. A guide ring is provided across right lateral surfaces of the attachment pins. A first side guide member to support a right lateral surface of a drive ring in away that allows the right lateral surface to be in sliding contact therewith is provided to the right of the guide ring. A second side guide member to support a left lateral surface of the drive ring in a way that allows the left lateral surface to be in sliding contact therewith is provided to the right of the guide ring.

9 Claims, 8 Drawing Sheets

(56) References Cited

FOREIGN PATENT DOCUMENTS

| | | | | |
|---|---|---|---|---|
| JP | 2002-38963 | | | 2/2002 |
| JP | 2008-215083 | | | 9/2008 |
| JP | 2009-243431 | A | | 10/2009 |
| JP | 2010-65591 | | | 3/2010 |
| JP | 2010-71138 | | | 4/2010 |
| JP | 2010-71142 | | | 4/2010 |
| JP | 2010-180864 | | | 8/2010 |
| JP | 2011-94499 | A | | 5/2011 |
| JP | 2012-97710 | | | 5/2012 |
| JP | 2013213494 | A | * | 10/2013 |
| WO | WO 2009/081642 | A1 | | 7/2009 |
| WO | WO 2010/058788 | A1 | | 5/2010 |

OTHER PUBLICATIONS

Combined Chinese Office Action and Search Report issued Apr. 27, 2015 in Patent Application No. 201410178963.0 (with Partial English Translation of Office Action and Search Report).

* cited by examiner

VARIABLE NOZZLE UNIT AND VARIABLE GEOMETRY SYSTEM TURBOCHARGER

BACKGROUND OF THE INVENTION

1. Field of the Invention

The present invention relates to a variable nozzle unit and a variable geometry system turbocharger, which are capable of changing a passage area for (a flow rate of) an exhaust gas to be supplied to a turbine impeller side in a variable geometry system turbocharger.

2. Description of the Related Art

Various developments for variable nozzle units to be installed in variable geometry system turbochargers have been underway in recent years (see Japanese Patent Application Laid-open Publications Nos. 2010-65591, 2010-71138 and 2010-71142). A concrete configuration common among variable nozzles unit based on the related art is as follows.

A base ring is arranged coaxial with a turbine impeller inside a turbine housing in a variable geometry system turbocharger. Multiple support holes are penetratingly formed in the base ring at equal intervals in the circumferential direction of the base ring. Furthermore, multiple variable nozzles are arranged on the base ring at equal intervals in the circumferential direction of the base ring in a way that the variable nozzles encompass the turbine impeller. Each variable nozzle is rotatable around its axis which is in parallel with the axis of the turbine impeller. Moreover, a nozzle shaft is integrally formed on a lateral surface of each variable nozzle. Each nozzle shaft penetrates the corresponding support hole in the base ring, and is rotatably supported by the support hole.

A link mechanism configured to synchronously rotate the multiple variable nozzles in forward and reverse directions (opening and closing directions) is arranged on one side of the base ring. To put it specifically, a guide ring is provided coaxial with the base ring in a section which is a part of a bearing housing in the variable geometry system turbocharger, and which is opposed to the back surface of the turbine impeller. Furthermore, a drive ring is rotatably provided on the outer peripheral surface of the guide ring. The drive ring rotates in forward and reverse directions by being driven by a rotary actuator. As many engagement portions as the variable nozzles are provided on a lateral surface of the drive ring at equal intervals in the circumferential direction of the drive ring. In addition, a base end portion of a synchronous link member (a nozzle link member) is integrally connected to the nozzle shaft of each variable nozzle. Tip end portions (tip end-side portions) of each synchronous link member are engaged with the corresponding engagement portion of the drive ring while nipping the engagement portion.

Thus, when an engine speed is in a high speed range and a flow rate of an exhaust gas is high, the rotary actuator drives and rotates the drive ring in the forward direction. Thereby, the multiple synchronous link members swing in the forward direction, and the multiple variable nozzles synchronously rotate in the forward direction (the opening direction). Accordingly, the passage area for the exhaust gas to be supplied to the turbine impeller side increases, and a larger amount of the exhaust gas is supplied to the turbine impeller.

On the other hand, when the engine speed is in a low speed range and the flow rate of the exhaust gas is low, the rotary actuator drives and rotates the drive ring in the reverse direction. Thereby, the multiple synchronous link members swing in the reverse direction, and the multiple variable nozzles synchronously rotate in the reverse direction (the closing direction). Accordingly, the passage area for the exhaust gas to be supplied to the turbine impeller side decreases, while a flow velocity of the exhaust gas increases. As a result, the amount of work done by the turbine impeller is secured sufficiently.

SUMMARY OF THE INVENTION

Meanwhile, sliding wear occurs between the inner peripheral surface of the drive ring and the outer peripheral surface of the guide ring. Depending on the operating condition of the engine, an increase in the wear may lead to deterioration in operation performance of the synchronous link members, such as non-smooth movement. In other words, reduction in the sliding wear between the inner peripheral surface of the drive ring and the outer peripheral surface of the guide ring is effective means for inhibiting the deterioration in the operation performance of the synchronous link members, and thereby improving the durability of the variable geometry system turbocharger.

With this taken into consideration, an object of the present invention is provide a variable nozzle unit and a variable geometry system turbocharger which are capable of reducing sliding wear between an inner peripheral surface of a drive ring and an outer peripheral surface of a guide ring.

A first aspect of the present invention provides a variable nozzle unit configured to adjust a passage area for (a flow rate of) an exhaust gas to be supplied to a turbine impeller in a variable geometry system turbocharger. The variable nozzle unit includes: a base ring arranged coaxial with the turbine impeller in a turbine housing in the variable geometry system turbocharger, and including multiple support holes penetratingly formed (formed) at intervals in a circumferential direction of the base ring; multiple variable nozzles arranged on the base ring at intervals, each variable nozzle being rotatable around its axis in parallel with an axis of the turbine impeller and being integrally provided with a nozzle shaft on a lateral surface thereof, the nozzle shaft being rotatably supported by the corresponding support hole in the base ring; and a link mechanism arranged on one side of the base ring and configured to synchronously rotate the multiple variable nozzles in forward and reverse directions (opening and closing directions). Here, the link mechanism includes: three or more attachment pins arranged on a lateral surface of the base ring on the one side at intervals in the circumferential direction of the base ring, the attachment pins placed outside the support holes in the base ring in radial directions of the base ring; a guide ring provided across the multiple attachment pins and placed coaxial with the base ring; a drive ring being rotatably provided on an outer peripheral surface of the guide ring, including as many engagement portions as the variable nozzles provided on a lateral surface of the drive ring at intervals in a circumferential direction of the drive ring, and being configured to rotate in forward and reverse directions by being driven by an rotary actuator; a first side guide member (a first wall surface guide member) provided on one side of the guide ring (a lateral surface on one side in the axial direction) and configured to support a lateral surface (a wall surface) of the drive ring on the one side in a way that allows the lateral surface to be in sliding contact with the first side guide member; a second side guide member (a second wall surface guide member) provided on an opposite side of the guide ring (a lateral surface on an opposite side in the axial direction) and configured to support a lateral surface (a wall surface) of the drive ring on the opposite side in a way that allows the lateral surface to be in sliding contact with the second side guide member; and a synchronous link member (a nozzle link member) including a base end portion integrally connected to the nozzle shaft of each variable nozzle, and tip end portions (tip end side portions) engaged with each engagement portion of the drive ring while nipping the engagement portion.

It should be noted that in the description and the claims in the application concerned, "arranged" means being arranged directly, and additionally connotes being arranged indirectly with the assistance of another member, while "provided" means being provided directly, and additionally connotes being provided indirectly with the assistance of another member. In addition, "integrally provided" connotes being integrally formed.

A second aspect of the present invention provides a variable geometry system turbocharger configured to supercharge air to be supplied to an engine by use of energy of an exhaust gas from the engine, which includes the variable nozzle unit according to the first aspect.

The present invention makes it possible to increase the area of the contact between the drive ring and the guide ring, and to stabilize the rotating action of the drive ring while the variable geometry system turbocharger is in operation. For these reasons, it is possible to sufficiently reduce sliding wear between the inner peripheral surface of the drive ring and the outer peripheral surface of the guide ring, to inhibit deterioration in operation performance of the synchronous link members, and to improve the durability of the variable geometry system turbocharger.

DETAILED DESCRIPTION OF EMBODIMENTS

Figure 1:
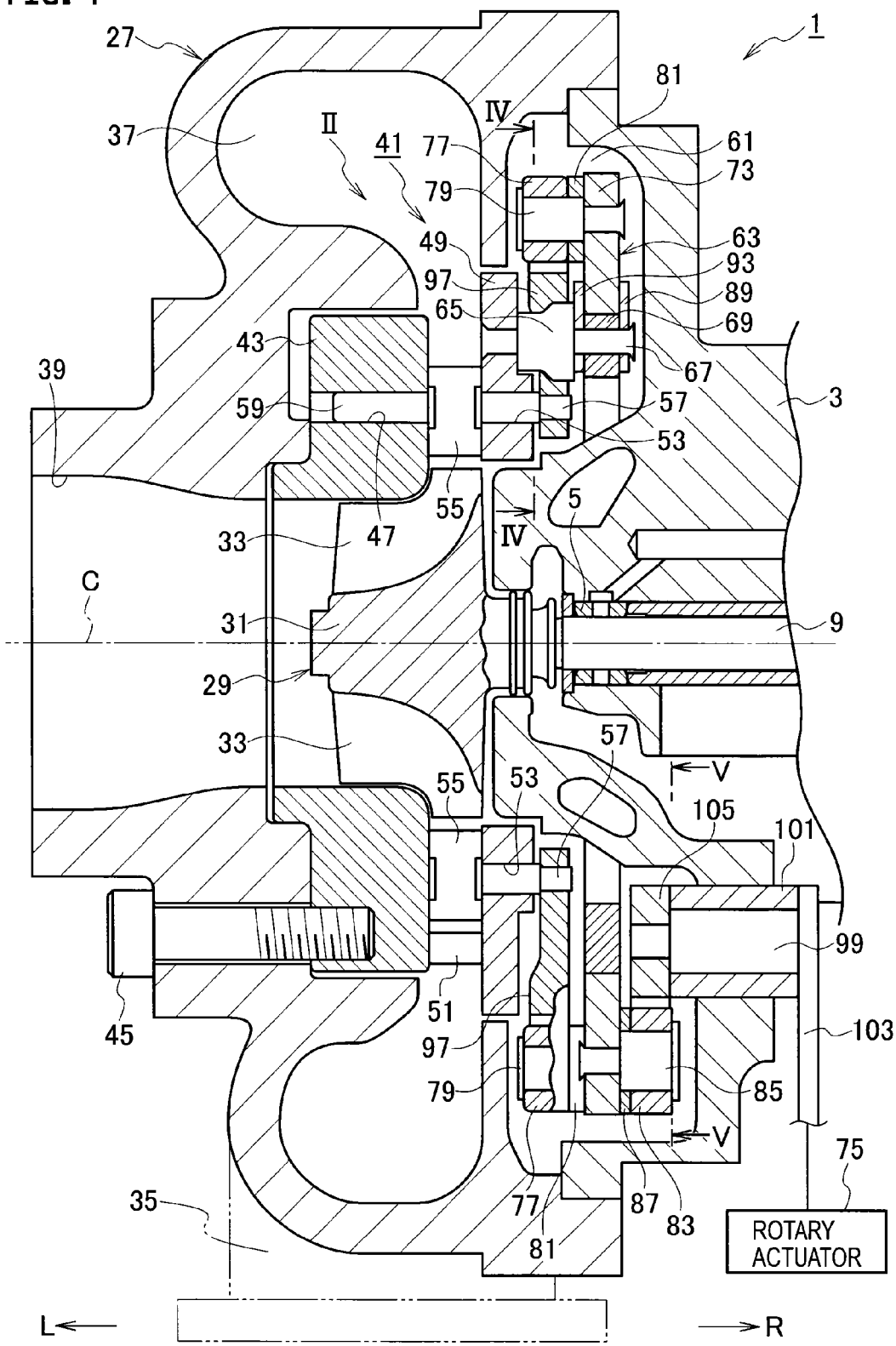
FIG. 1 is a magnified view of a portion indicated with an arrow I in FIG. 6.

Referring to FIGS. 1 to 6, descriptions will be hereinbelow provided for embodiments of the present invention. In the drawings, the sign "R" indicates rightward while the sign "L" indicates leftward.

Figure 6:
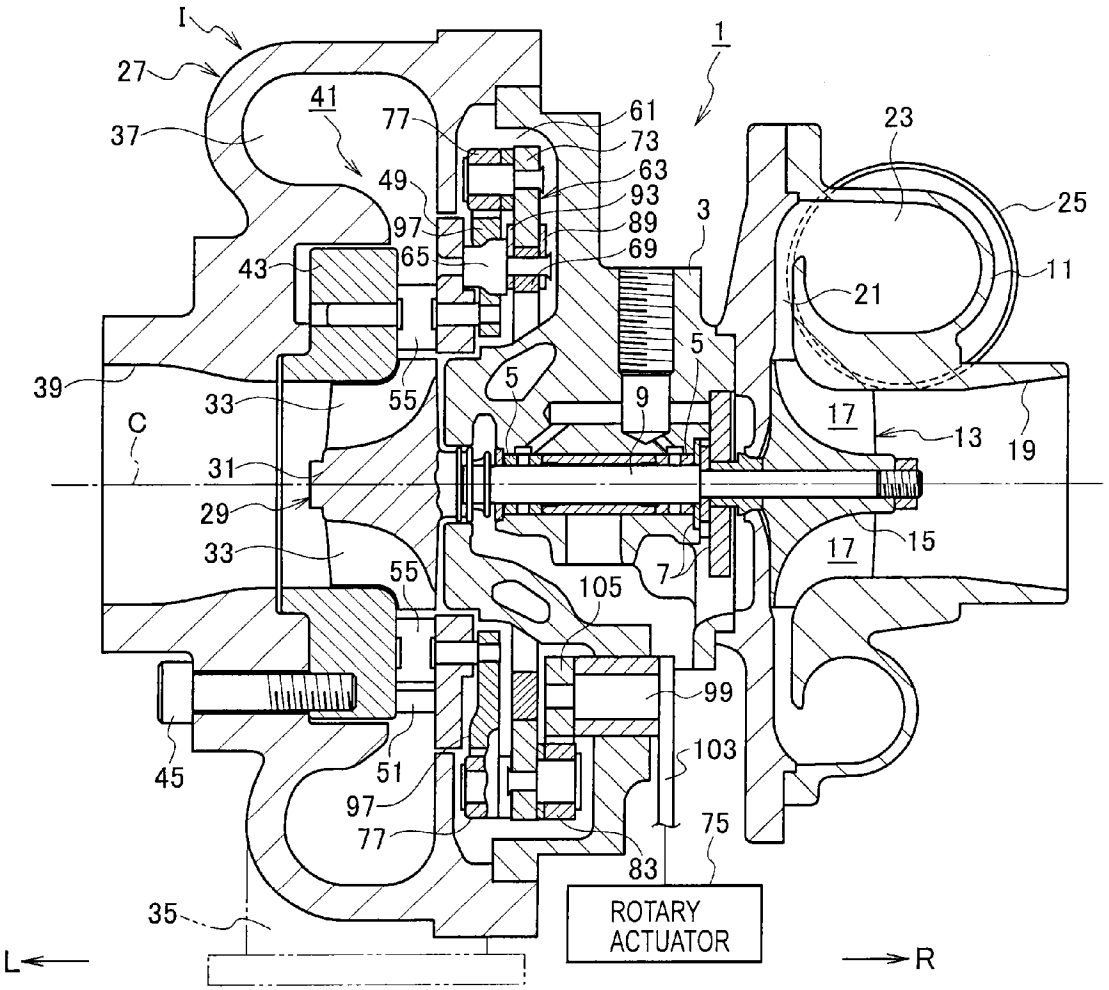
FIG. 6 is a front cross-sectional view of a variable geometry system turbocharger of the embodiment of the present invention.

As shown in FIG. 6, a variable geometry system turbocharger 1 of an embodiment of the present invention supercharges (compresses) air to be supplied to an engine (not shown) by use of energy of an exhaust gas from the engine.

The variable geometry system turbocharger 1 includes a bearing housing 3. A radial bearing 5 and a pair of thrust bearings 7 are provided inside the bearing housing 3. A rotor shaft (a turbine shaft) 9 extending in the left-right direction is rotatably provided to the multiple bearings 5, 7. In other words, the rotor shaft 9 is rotatably provided inside the bearing housing 3 with the assistance of the multiple bearings 5, 7.

A compressor housing 11 is provided to the right of the bearing housing 3. Inside the compressor housing 11, a compressor impeller 13 is provided rotatable around its axis (in other words, the axis of the rotor shaft 9) C. The compressor impeller 13 compresses the air by use of centrifugal force. The compressor impeller 13 includes: a compressor wheel (a compressor disk) 15 integrally connected to the right end portion of the rotor shaft 9; and multiple compressor blades 17 provided on the outer peripheral surface of the compressor wheel 15 at equal intervals in the circumferential direction of the compressor wheel 15.

An air introduction port 19 configured to introduce the air is formed in the compressor housing 11 on the inlet side of the compressor impeller 13 (in other words, in the right side portion of the compressor housing 11). The air introduction port 19 is connected to an air cleaner (not shown) configured to clean the air. An annular diffuser passage 21 configured to boost the pressure of the compressed air is formed in the bearing housing 3 on the outlet side of the compressor impeller 13 (in other words, between the bearing housing 3 and the compressor housing 11). A compressor scroll passage 23 shaped like a scroll is formed inside the compressor housing 11. The compressor scroll passage 23 communicates with the diffuser passage 21. An air discharge port 25 configured to discharge the compressed air is formed at an appropriate position in the compressor housing 11. The air discharge port 25 communicates with the compressor scroll passage 23, and is connected to an intake manifold (not shown) of the engine.

As shown in FIGS. 1 and 6, a turbine housing 27 is provided on the left side of the bearing housing 3. Inside the turbine housing 27, a turbine impeller 29 is provided rotatable around its axis (the axis of the turbine impeller 29, in other words, the axis of the rotor shaft 9) C. The turbine impeller 29 generates rotational force (rotational torque) by use of energy of the exhaust gas. The turbine impeller 29 includes: a turbine wheel (a turbine disk) 31 integrally connected to the left end portion of the rotor shaft 9; and multiple turbine blades 33 provided on the outer peripheral surface of the turbine wheel 31 at equal intervals in the circumferential direction of the turbine wheel 31.

A gas introduction port 35 configured to introduce the exhaust gas is formed at an appropriate position in the turbine housing 27. The gas introduction port 35 is connected to an exhaust manifold (not shown) of the engine. A turbine scroll passage 37 in a scroll shape is formed inside the turbine housing 27. The turbine scroll passage 37 communicates with the gas introduction port 35. A gas discharge port 39 configured to discharge the exhaust gas is formed in the turbine housing 27 on the outlet side of the turbine impeller 29 (in other words, in the left side portion of the turbine housing 27). The gas discharge port 39 is connected to an exhaust emission control system (not shown) configured to clean the exhaust gas.

The variable geometry system turbocharger 1 is equipped with a variable nozzle unit 41 configured to adjust a passage area for (or a flow rate of) the exhaust gas to be supplied to the turbine impeller 29 side. A detailed configuration of the variable nozzle unit 41 is as follows.

Figure 2:
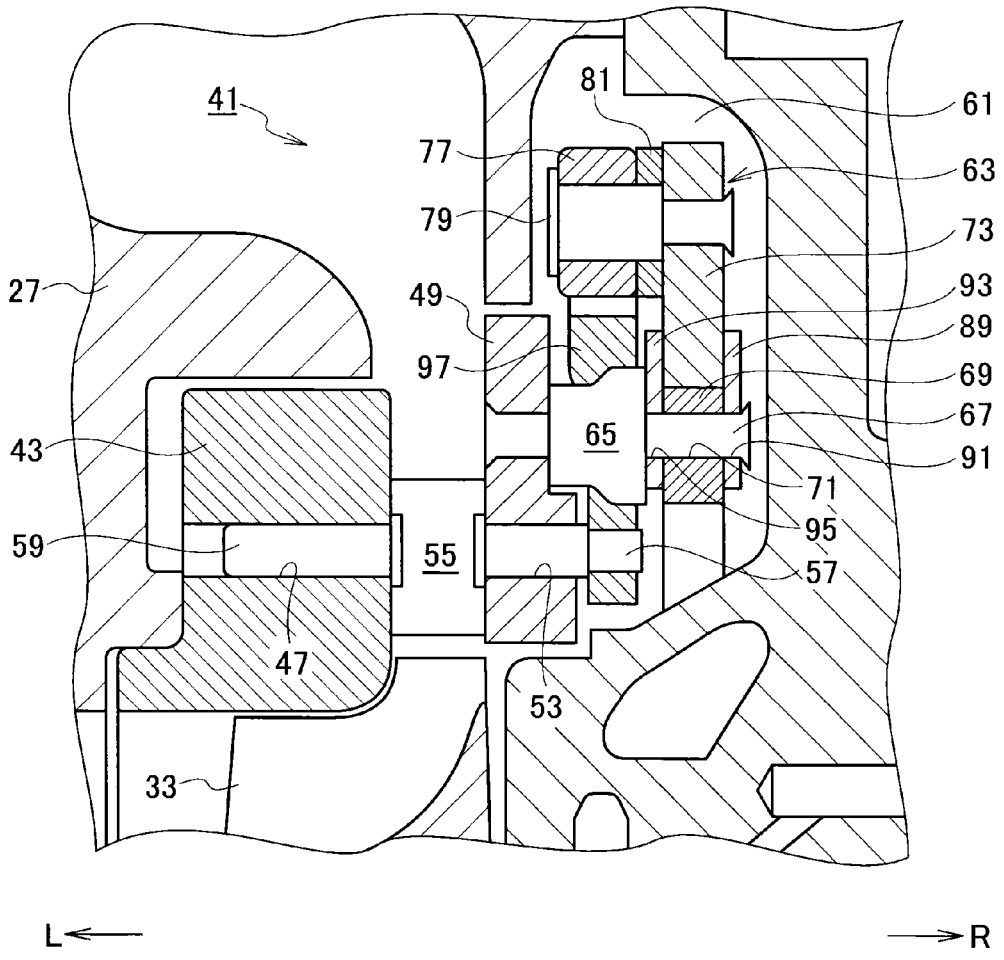
FIG. 2 is a magnified view of a portion indicated with an arrow II in FIG. 1.

As shown in FIGS. 1 and 2, a shroud ring 43 as a first base ring is provided inside the turbine housing 27. The shroud ring 43 is arranged coaxial with the turbine impeller 29 with the assistance of multiple attachment bolts 45, albeit only one of them is illustrated. The shroud ring 43 is formed, covering the outer edges (the tip end edges) of the multiple turbine blades 33. Multiple support holes 47, albeit only one of them is illustrated, are penetratingly formed in the shroud ring 43 at intervals in the circumferential direction of the shroud ring 43. Incidentally, the intervals may be equal to one another.

A nozzle ring 49 as a second base ring is provided at a position away from and opposed to the shroud ring 43 in the left-right direction (in the shaft direction of the turbine impeller 29). The nozzle ring 49 is provided integral and coaxial with the shroud ring 43 with the assistance of multiple connection pins 51, albeit only one of them is illustrated. Multiple support holes 53 are penetratingly formed in the nozzle ring 49 at intervals in the circumferential direction of the nozzle ring 49 in a way to match the multiple support holes 47 in the shroud ring 43. Incidentally, the intervals may be equal to one another. In this respect, the multiple connection pins 51 have a function to define a clearance between the shroud ring 43 and the nozzle ring 49.

Multiple variable nozzles 55 are provided between the shroud ring 43 and the nozzle ring 49. The multiple variable nozzles 55 are arranged at intervals in the circumferential direction of the turbine impeller 29 in a way that the variable nozzles 55 encompass the turbine impeller 29. Incidentally, the intervals may be equal to one another. Each variable nozzle 55 is rotatable around its axis parallel to the axis C of the turbine impeller 29 in forward and reverse directions (in opening and closing directions). A nozzle shaft 57 is integrally formed on the right lateral surface of each variable nozzle 55 (a lateral surface of the variable nozzle 55 on one side in the axial direction). Each nozzle shaft 57 is rotatably supported by the corresponding support hole 53 in the nozzle ring 49. The other nozzle shaft 59 is integrally formed on the left lateral surface of each variable nozzle 55 (a lateral surface of the variable nozzle 55 on the other side in the axial direction). Each nozzle shaft 59 is rotatably supported by the corresponding support hole 47 in the shroud ring 43.

Each variable nozzle 55 is of a both-end-supported type, which includes the nozzle shafts 57, 59. Nevertheless, each variable nozzle 55 may be of a cantilever type without the nozzle shaft 59.

An annular link chamber 61 is defined on the right lateral surface of the nozzle ring 49 (a lateral surface of the nozzle ring 49 on the one side in the axial direction). The major part of a link mechanism 63 is placed inside the link chamber 61. The link mechanism 63 synchronously rotates the multiple variable nozzles 55 in the forward and reverse directions (in the opening and closing directions). The concrete configuration of the link mechanism 63 in the variable nozzle unit 41 is as follows.

Figure 3:
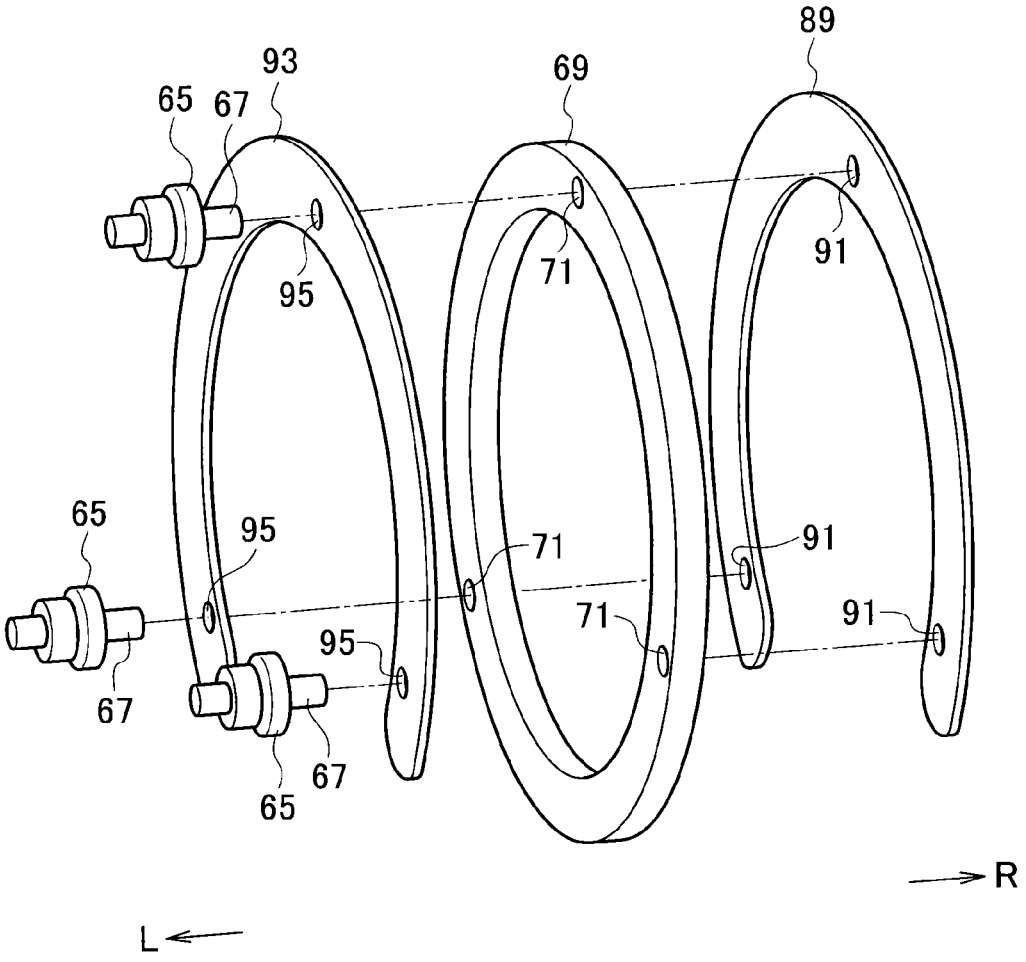
FIG. 3 is a perspective view showing a relationship among multiple attachment pins, a guide ring, a first side guide member and a second side guide member in a variable nozzle unit of an embodiment of the present invention.
Figure 4:
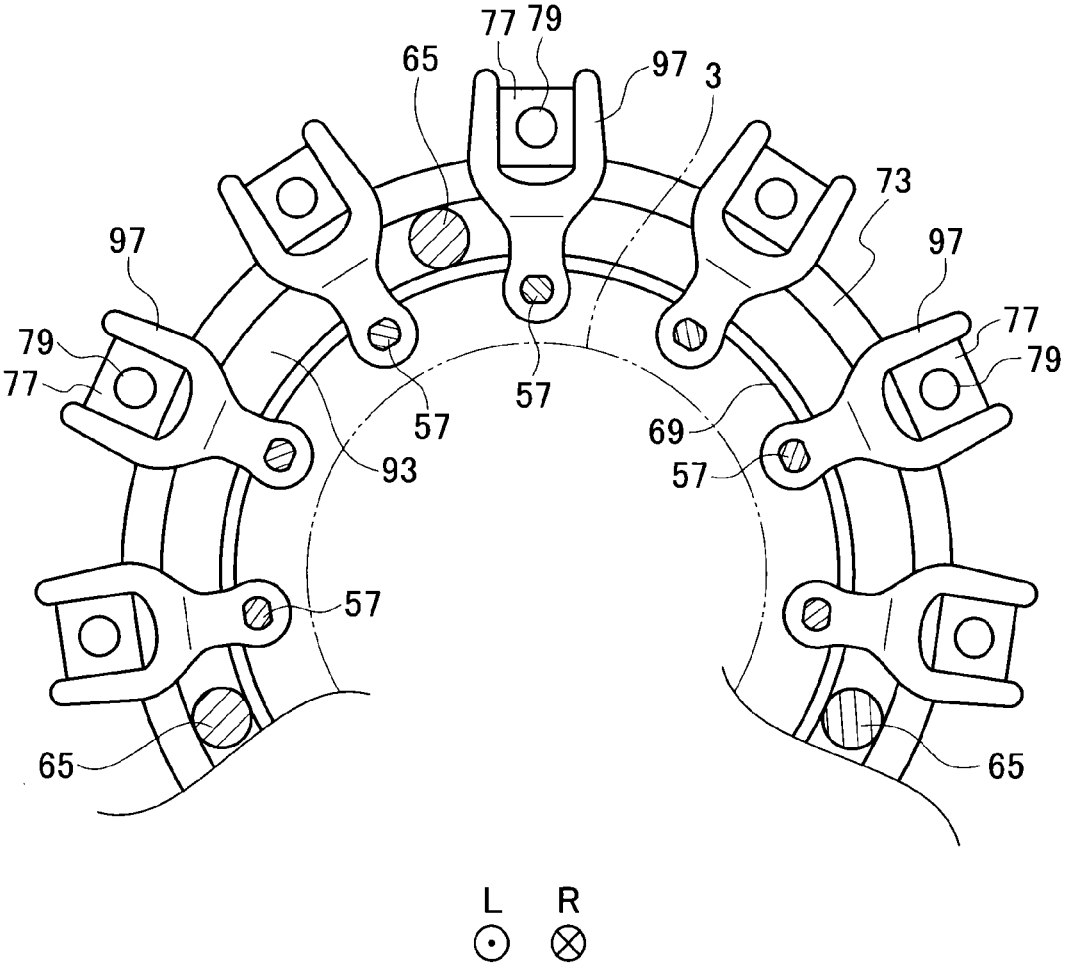
FIG. 4 is a diagram taken along the IV-IV line of FIG. 1.
Figure 5:
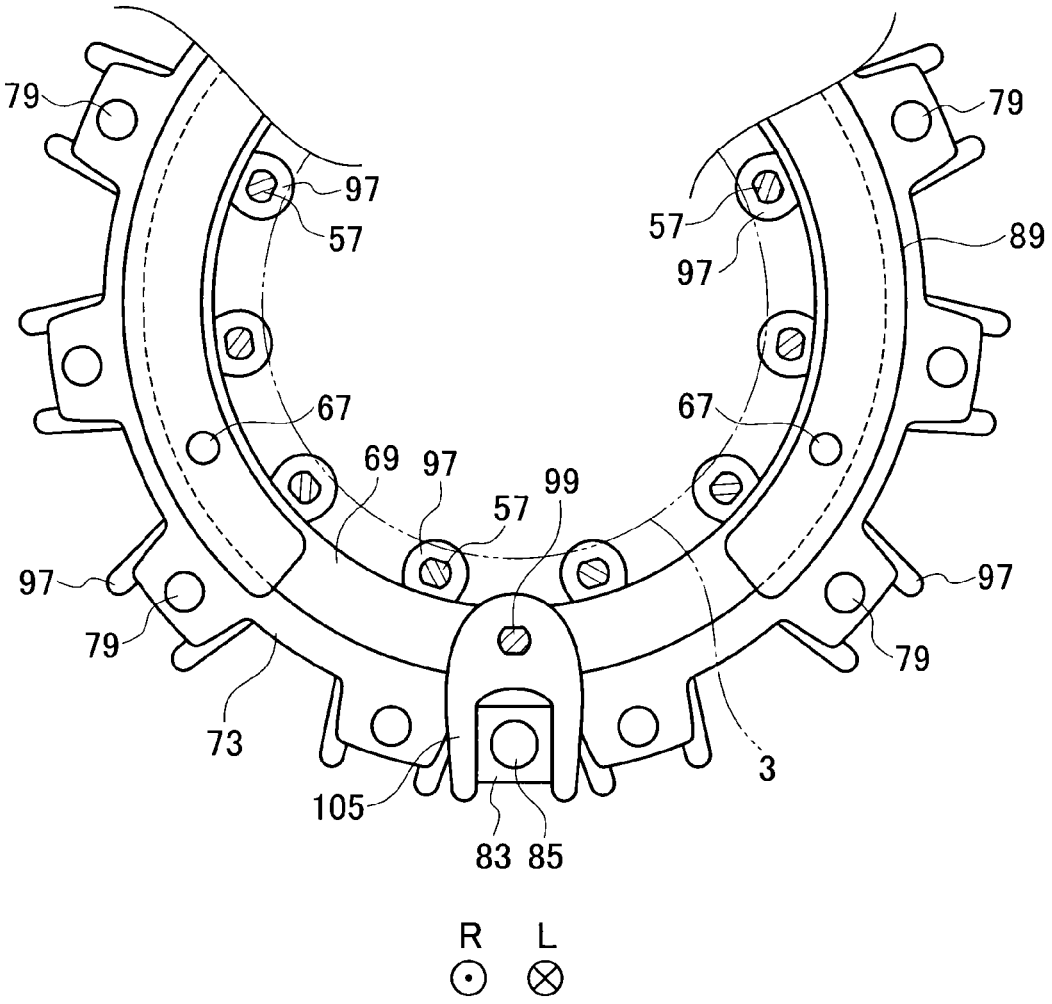
FIG. 5 is a diagram taken along the V-V line of FIG. 1.

As shown in FIGS. 1 to 3, three or more (three in the embodiment) attachment pins 65 are arranged on the right lateral surface of the nozzle ring 49 at intervals in the circumferential direction of the nozzle ring 49. The attachment pins 65 are formed symmetrical to one another with respect to the axis, and are placed outside the support holes 53 in the nozzle ring 49 in radial directions of the nozzle ring 49. An attachment shaft 67 is integrally formed on the tip end surface of each attachment pin 65 (an end surface of the attachment pin 65 on the one side in the axial direction).

A guide ring 69 is provided across the tip end surfaces of the multiple attachment pins 65. The guide ring 69 is placed coaxial with the nozzle ring 49. Three or more (three in the embodiment) insertion holes (guide ring insertion holes) 71 through which to insert the attachment shafts 67 of the attachment pins 65 are penetratingly formed in the guide ring 69 at intervals in the circumferential direction of the guide ring 69.

As shown in FIGS. 1, 2, 4 and 5, a drive ring 73 is rotatably provided on the outer peripheral surface of the guide ring 69. The drive ring 73 rotates in the forward and reverse directions by being driven by a rotary actuator 75 such as an electric motor or a hydraulic cylinder. The outer peripheral portion of the drive ring 73 is formed into (shaped like) a gear. As many rectangular engagement joints (engagement portions) 77 as the variable nozzles 55 are provided on the left lateral surface of the drive ring 73. The engagement joints 77 are provided at intervals in the circumferential direction of the drive ring 73 with the assistance of connection pins 79 and washers 81, respectively. Incidentally, the intervals may be equal to one another. A rectangular engagement joint (a different engagement portion) 83 is provided on the right lateral surface of the drive ring 73 with the assistance of a connection pin 85 and washer 87.

As shown in FIGS. 2 and 3, a first side guide member (a first wall surface guide member) 89 is provided to the right (on the lateral surface) of the guide ring 69 with the assistance of the attachment shafts 67 of the multiple attachment pins 65. The first side guide member 89 supports the right lateral surface (the right wall surface) of the drive ring 73 in a way that allows the right lateral surface to be in sliding contact with the first side guide member 89. The first side guide member 89 is shaped like a plate (a flat plate) and the letter C (in other words, a ring whose circumference is partially cut away), and is produced by press working, for example. Three or more (three in the embodiment) insertion holes (first side guide member insertion holes) 91 through which to insert the attachment shafts 67 of the attachment pins 65 are penetratingly formed in the first side guide member 89 at intervals in the circumferential direction of the first side guide member 89.

A second side guide member (a second wall surface guide member) 93 is provided to the left (on the left lateral surface) of the guide ring 69 with the assistance of the attachment shafts 67 of the multiple attachment pins 65. The second side guide member 93 supports the left lateral surface (the left wall surface) of the drive ring 73 in a way that allows the left lateral surface of the drive ring 73 to be in sliding contact with the second side guide member 93. Like the first side guide member 89, the second side guide member 93 is shaped like a plate and the letter C, and is produced by press working, for example. Three or more (three in the embodiment) insertion holes (second side guide member insertion holes) 95 through which to insert the attachment shafts 67 of the attachment pins 65 are penetratingly formed in the second side guide member 93 at intervals in the circumferential direction of the second side guide member 93.

It should be noted that the first side guide member 89 and the second side guide member 93 may be formed in the shape of a plate and a ring.

As shown in FIGS. 1, 2, 4 and 5, a base end portion of a synchronous link member (a nozzle link member) 97 is integrally connected to the tip end portion (the right end portion) of the nozzle shaft 57 of each variable nozzle 55. Two tip end portions into which each synchronous link member 97 bifurcates are engaged with the corresponding engagement joint 77 of the drive ring 73 while nipping the engagement joint 77.

A drive shaft 99 is provided in the left side portion of the bearing housing 3 as a fixing portion of the variable geometry system turbocharger 1 with the assistance of a bush 101. The drive shaft 99 is rotatable around its axis which is in parallel with the axis C of the turbine impeller 29. The right end portion (one end portion) of the drive shaft 99 is connected to the rotary actuator 75 via a power transmission mechanism 103. A base end portion of a drive link member 105 is integrally connected to the left end portion (the other end portion) of the drive shaft 99. Two tip end portions into which the drive link member 105 bifurcates are engaged with the engagement joint 83 of the drive ring 73 while nipping the engagement joint 83.

Descriptions will be hereinbelow provided for the operation and effects of the embodiment.

The exhaust gas is introduced through the gas introduction port 35, passes through the turbine scroll passage 37, and flows from the inlet to the outlet of the turbine impeller 29. This flow of the exhaust gas generates the rotational force (the rotational torque) by use of the energy of the exhaust gas. Thus, the rotor shaft 9 and the compressor impeller 13 rotate integrally with the turbine impeller 29. Thereby, the air introduced through the air introduction port 19 is compressed, passes through the diffuser passage 21 and the compressor scroll passage 23, and is discharged through the air discharge port 25. Accordingly, the air supplied to the engine can be supercharged (compressed).

While the variable geometry system turbocharger 1 is in operation, the drive shaft 99 rotates in one direction (in the clockwise direction in FIG. 5) by being driven the rotary actuator 75 if the engine speed is in a high speed range and the flow rate of the exhaust gas is high. The rotation of the drive shaft 99 rotates the drive ring 73 in the forward direction (in the counterclockwise direction in FIG. 4, and in the clockwise direction in FIG. 5) while swinging the drive link member 105 in the one direction. This synchronously rotates the multiple variable nozzles 55 in the forward direction (in the opening direction) while swinging the multiple synchronous link members 97 in the forward direction. As a result, the opening angles of the multiple variable nozzles 55 become larger, and the passage area for (the flow rate of) the exhaust gas to be supplied to the turbine impeller 29 side becomes accordingly larger. This makes it possible to supply a larger amount of the exhaust gas to the turbine impeller 29 side.

If the engine speed is in a low speed range and the flow rate of the exhaust gas is low, the drive shaft 99 rotates in the other direction (in the counterclockwise direction in FIG. 5) by being driven by the rotary actuator 75. The rotation of the drive shaft 99 rotates the drive ring 73 in the reverse direction (in the clockwise direction in FIG. 4, and in the counterclockwise direction in FIG. 5) while swinging the drive link member 105 in the other direction. This synchronously rotates the multiple variable nozzles 55 in the reverse direction (in the closing direction) while swinging the multiple synchronous link members 97 in the reverse direction. As a result, the opening angles of the multiple variable nozzles 55 become smaller, and the passage area for the exhaust gas to be supplied to the turbine impeller 29 becomes accordingly smaller. The decrease in the passage area makes the flow velocity of the exhaust gas become higher. For this reason, the amount of work to be done by the turbine impeller 29 can be secured sufficiently.

As described above, the three or more attachment pins 65 are arranged on the right lateral surface of the nozzle ring 49 at the intervals in the circumferential direction. All the attachment pins 65 are placed outside the support holes 53 in the nozzle ring 49 in the radial directions of the nozzle ring 49. In addition, the guide ring 69 is provided across the right lateral surfaces of the multiple attachment pins 65. For these reasons, a swing space in which to swing the synchronous link members 97 can be secured between the nozzle ring 49 and the guide ring 69. Furthermore, the radius of the outer peripheral surface of the guide ring 69 (in other words, the radius of the inner peripheral surface of the drive ring 73) can be made greater than the length from the axis C of the turbine impeller 29 to the axis of each variable nozzle 55. This makes it possible to increase an area of contact between the drive ring 73 and the guide ring 69 while avoiding interference between the drive ring 73 and the synchronous link members 97 while the variable geometry system turbocharger 1 is in operation.

The first side guide member 89 is provided to the right of the guide ring 69, while the second side guide member 93 is provided to the left of the guide ring 69. The first side guide member 89 supports the right lateral surface of the drive ring 73 in a way that allows the right lateral surface of the drive ring 73 to be in sliding contact with the first side guide member 89, while the second side guide member 93 supports the left lateral surface of the drive ring 73 in a way that allows the left lateral surface of the drive ring 73 to be in sliding contact with the second side guide member 93. For this reason, backlash of the drive ring 73 in the left-right direction (in the axial direction) can be inhibited while the variable geometry system turbocharger 1 is in operation, and the rotating action of the drive ring 73 can be accordingly stabilized. Particularly, since the first and second side guide members 89, 93 are C-shaped, (part of) thermal stress occurring in the first and second side guide members 89, 93 while the variable geometry system turbocharger 1 is in operation can be dissipated, and thermal deformation of the first and second side guide members 89, 93 can be accordingly inhibited while the variable geometry system turbocharger 1 is in operation. This makes it possible to further stabilize the rotating action of the drive ring 73.

The embodiment of the present invention makes it possible to increase the area of contact between the drive ring 73 and the guide ring 69, and to stabilize the rotating action of the drive ring 73 while the variable geometry system turbocharger 1 is in operation. Accordingly, it is possible to sufficiently reduce sliding wear between the inner peripheral surface of the drive ring 73 and the outer peripheral surface of the guide ring 69, to inhibit deterioration in operation performance of the synchronous link members 97, and to improve the durability of the variable geometry system turbocharger 1.

Other Embodiments

Figure 7:
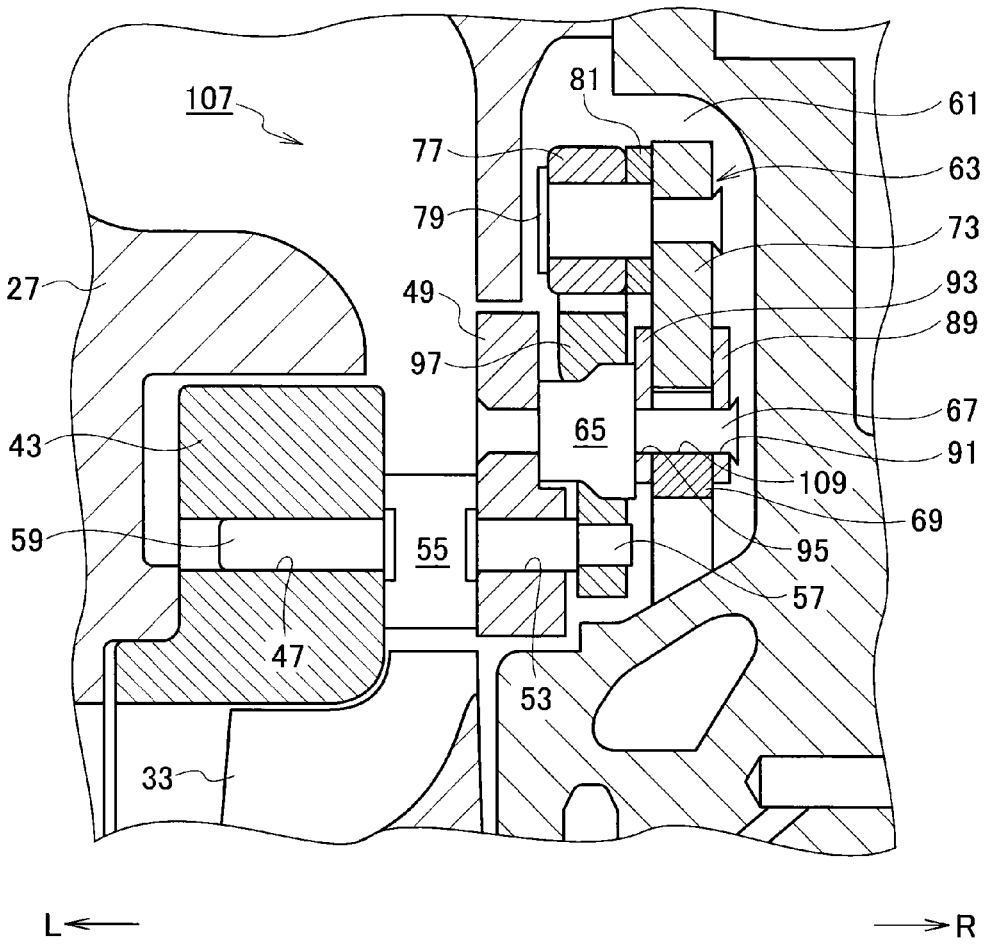
FIG. 7 is a diagram of the variable geometry system turbocharger of the embodiment of the present invention in which the variable nozzle unit of the embodiment of the present invention is replaced with a variable nozzle unit of a different embodiment of the present invention.
Figure 8:
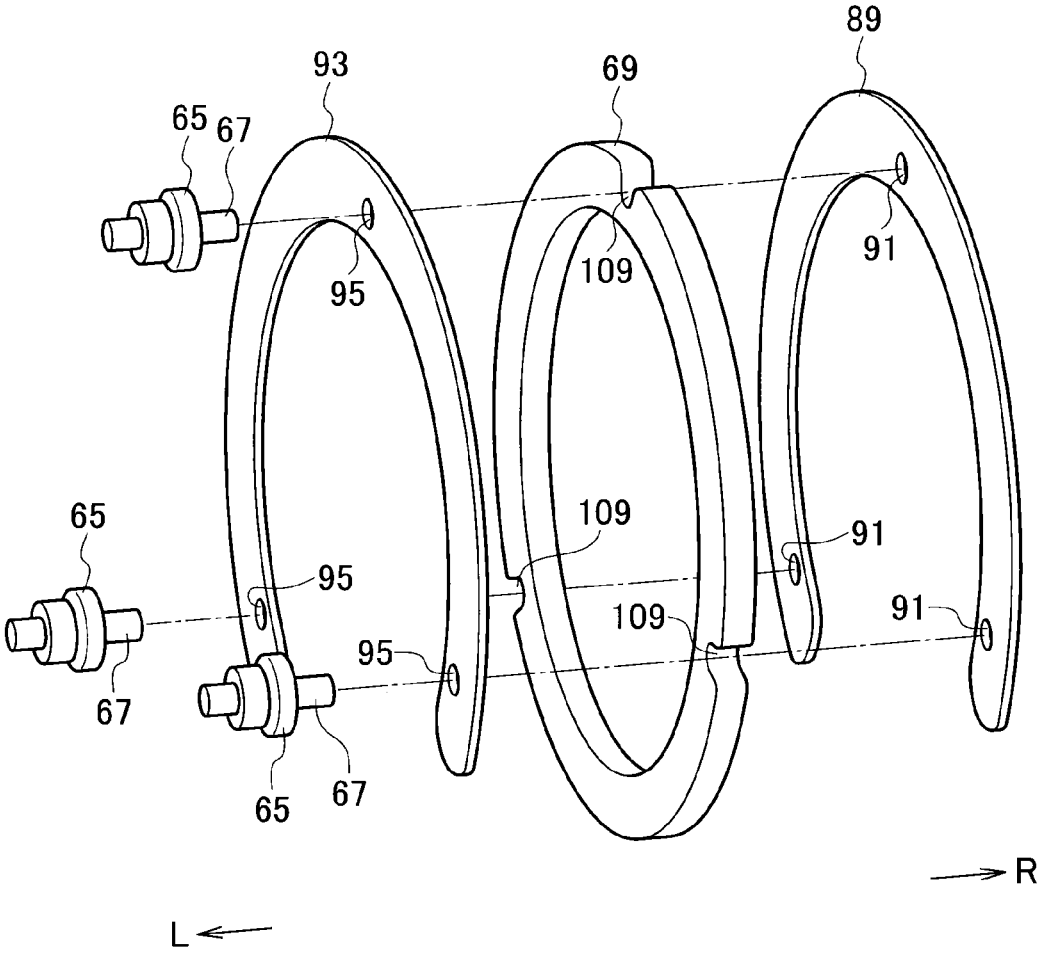
FIG. 8 is a perspective view showing a relationship among multiple attachment pins, a guide ring, a first side guide member and a second side guide member in the variable nozzle unit of the different embodiment of the present invention.

Referring to FIGS. 7 and 8, descriptions will be provided for another embodiment of the present invention. It should be noted that in the drawings, the sign "R" indicates rightward while the sign "L" indicates leftward.

As shown in FIG. 7, in the embodiment, the variable geometry system turbocharger 1 is equipped with a variable nozzle unit 107 (see FIG. 6) instead of the variable nozzle unit 41 (see FIG. 1). The variable nozzle unit 107 has a configuration similar to that of the variable nozzle unit 41. For this reason, descriptions will be provided for what makes the configuration of the variable nozzle unit 107 different from the configuration of the variable nozzle unit 41. Of the multiple components of the variable nozzle unit 107, those corresponding to the components of the variable nozzle unit 41 are denoted by the same reference signs in FIGS. 7 and 8.

As shown in FIGS. 7 and 8, three or more (three in the embodiment) engagement recessed portions 109 with which the attachment shafts 67 of the attachment pins 65 are to be engaged are formed in the outer peripheral surface of the guide ring 69 at intervals in the circumferential direction of the guide ring 69. In other words, the engagement recessed portions 109 are formed instead of the insertion holes 71 shown in FIG. 3. All the engagement recessed portions 109 are set further back inward in the radial directions of the guide ring 69 from the outer peripheral surface of the guide ring 69. It should be noted that, instead of the three or more engagement recessed portions 109 being formed in the outer peripheral surface of the guide ring 69, three or more (three in the embodiment) engagement recessed portions (not shown) may be formed in the inner peripheral surface of the guide ring 69 for the purpose of engaging the attachment shafts 67 of the attachment pins 65 with the engagement recessed portions. In this case, the engagement recessed portions are formed in the inner peripheral surface of the guide ring 69 at intervals in the circumferential direction of the guide ring 69; and the engagement recessed portions are set further back outward in the radial directions of the guide rings 69 from the inner peripheral surface of the guide ring 69.

The embodiment brings about the same working and effects as the preceding embodiment.

It should be noted that the present invention is not limited to the foregoing embodiments. The invention can be carried out in various modes including the following one. For example, a configuration may be employed in which the nozzle ring 49 is used as the first base ring and the shroud ring 43 is used as the second base ring, instead of the configuration in which the shroud ring 43 is used as the first base ring and the nozzle ring 49 is used as the second base ring. In this case, the drive shaft 99 is provided in the turbine housing 27 in a way that the drive shaft 99 is rotatable in the forward and reverse directions around its axis which is in parallel with the axis C of the turbine impeller 29. Furthermore, the scope of rights covered by the present invention is not limited to these embodiments.

What is claimed is:

1. A variable nozzle unit configured to adjust a passage area for an exhaust gas to be supplied to a turbine impeller in a variable geometry system turbocharger, comprising:

a base ring arranged coaxial with the turbine impeller in a turbine housing in the variable geometry system turbocharger, and including a plurality of support holes penetratingly formed at intervals in a circumferential direction of the base ring;

a plurality of variable nozzles arranged on the base ring at intervals, each variable nozzle being rotatable around its axis in parallel with an axis of the turbine impeller and being integrally provided with a nozzle shaft on a lateral surface thereof, the nozzle shaft being rotatably supported by the corresponding support hole in the base ring; and a link mechanism arranged on one side of the base ring and configured to synchronously rotate the plurality of variable nozzles in forward and reverse directions, wherein the link mechanism comprises:

three or more attachment pins arranged on a lateral surface of the base ring on the one side at intervals in the circumferential direction of the base ring, the three or more attachment pins placed outside the plurality of support holes in the base ring in radial directions of the base ring;

a guide ring provided across the plurality of attachment pins and placed coaxial with the base ring;

a drive ring being rotatably provided on an outer peripheral surface of the guide ring, including as many engagement portions as the plurality of variable nozzles provided on the drive ring at intervals in a circumferential direction of the drive ring, and being configured to rotate in forward and reverse directions by being driven by an rotary actuator;

a first side guide member provided on one side of the guide ring and configured to support a lateral surface of the drive ring on the one side in a way that allows the lateral surface to be in sliding contact with the first side guide member;

a second side guide member provided on an opposite side of the guide ring and configured to support a lateral surface of the drive ring on the opposite side in a way that allows the lateral surface to be in sliding contact with the second side guide member; and a synchronous link member including a base end portion integrally connected to the nozzle shaft of each variable nozzle, and tip end portions engaged with each engagement portion of the drive ring.

2. The variable nozzle according to claim 1, wherein attachment shafts are integrally formed on tip end surfaces of the three or more attachment pins, respectively, the guide ring includes any of: three or more insertion holes through which to insert the attachment shafts of the attachment pins, the insertion holes being penetratingly formed in the guide ring at intervals in a circumferential direction of the guide ring; and three or more engagement recessed portions with which to engage the attachment shafts of the attachment pins, the engagement recessed portions being formed in an outer or inner peripheral surface of the guide ring at intervals in the circumferential direction of the guide ring and set back inward or outward in radial directions of the guide ring, the first side guide member includes three or more insertion holes through which to insert the attachment shafts of the attachment pins, the insertion holes being formed at intervals in a circumferential direction of the first side guide member, and the second side guide member includes three or more insertion holes through which to insert the attachment shafts of the attachment pins, the insertion holes being formed at intervals in a circumferential direction of the second side guide member.

3. The variable nozzle unit according to claim 1, wherein the first and second side guide members are each C-shaped.

4. The variable nozzle unit according to claim 2, wherein the first and second side guide members are each C-shaped.

5. The variable nozzle unit according to claim 1, wherein the link mechanism further includes an additional engagement portion provided on the drive ring, and the link mechanism comprises:

a drive shaft provided rotatable around its axis in parallel with the axis of the turbine impeller in a fixing portion of the variable geometry system turbocharger, one end portion of the drive shaft connected to the rotary actuator; and a drive link member including a base end portion integrally connected to an opposite end portion of the drive shaft, and tip end portions being engaged with the different engagement portion of the drive ring while nipping the different engagement portion.

6. The variable nozzle unit according to claim 2, wherein the link mechanism further includes an additional engagement portion provided on the drive ring, and the link mechanism comprises:

a drive shaft provided rotatable around its axis in parallel with the axis of the turbine impeller in a fixing portion of the variable geometry system turbocharger, one end portion of the drive shaft connected to the rotary actuator; and a drive link member including a base end portion integrally connected to an opposite end portion of the drive shaft, and tip end portions being engaged with the different engagement portion of the drive ring.

7. The variable nozzle unit according to claim 3, wherein the link mechanism further includes an additional engagement portion provided on the drive ring, and the link mechanism comprises:

a drive shaft provided rotatable around its axis in parallel with the axis of the turbine impeller in a fixing portion of the variable geometry system turbocharger, one end portion of the drive shaft connected to the rotary actuator; and a drive link member including a base end portion integrally connected to an opposite end portion of the drive shaft, and tip end portions being engaged with the different engagement portion of the drive ring.

8. The variable nozzle unit according to claim 4, wherein the link mechanism further includes an additional engagement portion provided on the drive ring, and the link mechanism comprises:

a drive shaft provided rotatable around its axis in parallel with the axis of the turbine impeller in a fixing portion of the variable geometry system turbocharger, one end portion of the drive shaft connected to the rotary actuator; and a drive link member including a base end portion integrally connected to an opposite end portion of the drive shaft, and tip end portions being engaged with the different engagement portion of the drive ring.

9. A variable geometry system turbocharger configured to supercharge air to be supplied to an engine by use of energy of an exhaust gas from the engine, comprising the variable nozzle unit according to claim 1.

* * * * *